US007913705B2

(12) United States Patent
Benner

(10) Patent No.: US 7,913,705 B2
(45) Date of Patent: Mar. 29, 2011

(54) CLEANING CUP SYSTEM FOR CHEMICAL MECHANICAL PLANARIZATION APPARATUS

(75) Inventor: Stephen J. Benner, Lansdale, PA (US)

(73) Assignee: TBW Industries, Inc., Furlong, PA (US)

( * ) Notice: Subject to any disclaimer, the term of this patent is extended or adjusted under 35 U.S.C. 154(b) by 414 days.

(21) Appl. No.: 12/069,062

(22) Filed: Feb. 7, 2008

(65) Prior Publication Data

US 2008/0202568 A1 Aug. 28, 2008

Related U.S. Application Data

(60) Provisional application No. 60/899,976, filed on Feb. 7, 2007.

(51) Int. Cl.
*B08B 3/04* (2006.01)

(52) U.S. Cl. ..... 134/198

(58) Field of Classification Search ..... 134/198
See application file for complete search history.

(56) References Cited

U.S. PATENT DOCUMENTS

| | | | | |
|---|---|---|---|---|
| 4,934,393 | A | 6/1990 | Lighthall et al. | |
| 5,505,220 | A * | 4/1996 | Gorecki | 134/138 |
| 6,217,430 | B1 | 4/2001 | Koga et al. | |
| 6,358,124 | B1 * | 3/2002 | Koga et al. | 451/56 |
| 6,481,446 | B2 | 11/2002 | Yang et al. | |
| 6,554,688 | B2 | 4/2003 | Lacy | |
| 6,899,601 | B2 | 5/2005 | Boyd | |
| 6,942,223 | B2 | 9/2005 | Bleijenberg et al. | |
| 7,025,663 | B2 | 4/2006 | Kim | |
| 7,108,579 | B2 | 9/2006 | Wada et al. | |
| 2001/0041517 | A1 * | 11/2001 | Manfredi | 451/56 |
| 2002/0038803 | A1 * | 4/2002 | Malcolm | 220/713 |
| 2003/0010671 | A1 | 1/2003 | Orii et al. | |
| 2003/0015215 | A1 * | 1/2003 | Hsu et al. | 134/1 |
| 2003/0216112 | A1 * | 11/2003 | Gotze et al. | 451/56 |
| 2005/0048880 | A1 * | 3/2005 | Tolles et al. | 451/66 |

* cited by examiner

*Primary Examiner* — Michael Barr
*Assistant Examiner* — Samuel A Waldbaum
(74) *Attorney, Agent, or Firm* — Wendy W. Koba

(57) ABSTRACT

The present invention is related to an improved cleaning cup arrangement for CMP systems that efficiently and effectively removes most, if not all, of any slurry material present on the abrasive conditioning disk and conditioner head as they are resting in the cup between conditioning cycles. The cleaning cup of the present invention includes an underside water knife for directing a high velocity stream of cleaning fluid against the rotating abrasive disk (or conditioning brush, which may be used instead of a disk) surface, and at least a pair of spray stems for directing columns of cleaning fluid with sufficient cleaning force against all exposed portions of the conditioner head.

8 Claims, 6 Drawing Sheets

CLEANING CUP SYSTEM FOR CHEMICAL MECHANICAL PLANARIZATION APPARATUS

CROSS REFERENCE TO RELATED APPLICATION

This application claims the benefit of U.S. Provisional Application No. 60/899,976, filed Feb. 7, 2007.

TECHNICAL FIELD

The present invention relates to a cleaning cup system for use with chemical mechanical planarization (CMP) apparatus and, more particularly, to a cleaning cup system for removing particulate matter from a conditioner head (including the conditioning abrasive disk/brush) by the application of high velocity streams of cleaning fluids.

BACKGROUND OF THE INVENTION

Chemical mechanical planarization (CMP) is a process well-known in the art for processing surfaces of a semiconductor wafer. Planarization, in effect, polishes away a portion of the wafer's surface to form an ultra-smooth exposure upon which additional processing layers may be formed. CMP utilizes both a "mechanical" polishing pad to convey pressure which, in combination with tightly-controlled particulate material (component of polishing slurry) abrasively remove some material, as well as at least one chemically-reactive agent (component of polishing slurry) to initiate an "etching" or softening of surface materials. Over time, the polishing pad is known to experience buildup of excess compacted polishing slurry solids, hardened urethane pad materials (in response to heat, mechanical work, process chemicals, etc.), reacted materials and wafer debris, globally referred to as "glazing". In the art, therefore, it has become desirable to continually clean ("condition" or "dress") the polishing pad by removing trapped slurry and unmatting (re-expanding and/or texturing with mechanically 'cut' furrows) the pad material.

A number of conditioning procedures and apparatus have been developed. One conventional conditioner comprises an arm for holding a conditioner head with an abrasive disk facing the polishing pad. A bearing system rotatably supports the abrasive disk at the end of the arm. The abrasive disk rotates against the polishing pad to physically abrade the polishing pad and remove the glazing layer from the pad's surface.

While the abrasive disk is rotating against the polishing pad, slurry will tend to coat the edges and surfaces of the abrasive conditioning disk, as well as splash on the conditioner head itself. When the conditioner head is not operating (for example, between polishing operations), the slurry remaining on the abrasive disk and conditioner head can build up to form a hardened, caked surface. During the next polishing operation, therefore, the residual slurry film and particles may dislodge and fall onto the polishing pad and scratch the surface of the wafer being processed. The build-up or "fouling" commonly forms between abrasive grains, which service to decrease the abrasive particle exposure, which over time can reduce the abrasive penetration and thereby effectiveness of the conditioner. In systems where the chemistry may be modified between polishing and/or conditioning cycles, chemically dislodged material may further result in cross-contaminating subsequent wafers being processed.

The prior art has proposed various types of "cleaning cups" in which the conditioner head may be positioned when not being used, where the cups can be likened to a bath for the head, maintaining any slurry in a sufficiently liquid state to avoid the formation of hardened slurry particles during subsequent conditioning processes.

Initial prior art "cleaning cups" consisted of a bath of deionized water (or another cleaning fluid), which would hold the conditioner head in a submerged position between conditioning operations. U.S. Pat. No. 6,217,430 issued to R. Koga et al. on Apr. 17, 2001 discloses a prior art cleaning cup improvement over this basic arrangement, using a spray nozzle for spraying a cleaning solution on the top side of the conditioner head while the underside of the head (supporting the abrasive disk) remain submerged in the cleaning cup bath. U.S. Pat. No. 6,481,446 issued to M-S Yang et al. on Nov. 19, 2002 discloses an alternative cleaning cup structure, in this case including an apertured bottom support for allowing an injected inert gas to bubble up through the cleaning bath and assist in the removal of particles that are sticking to the abrasive conditioning disk. In a further example, U.S. Pat. No. 7,025,663 issued to T-B Kim on Apr. 11, 2006 describes a cleaning cup including a similar bubbler structure as taught by Yang et al., used in combination with a U-shaped spraying pipe that is provided with a plurality of nozzles to spray downward onto the conditioner head.

While these various prior art arrangements are considered improvements over the conventional "static bath", they have not been successful in completely removing all of the particulate residue from the conditioning head. It has been found that some of the slurry debris will remain adhered to the conditioner head, including the abrasive surface, resulting in a condition now referred to as "disk fouling"—the remaining residue causing a mechanical change in the abrasive quality of the conditioner head surface.

Thus, a need remains in the art for an arrangement that will successfully remove most, if not all, of the adherent residue from a CMP system conditioner head.

SUMMARY OF THE INVENTION

The needs remaining in the prior art are addressed by the present invention which relates to a cleaning cup system for use with CMP apparatus and, more particularly, to a cleaning cup system for removing residue from a conditioner head (including the conditioning abrasive surface) by the application of a plurality of separate high velocity streams of cleaning fluids which contain sufficient energy to atomize upon contact with the end effector surfaces and dislodge the remaining residue.

In accordance with the present invention, a cleaning cup apparatus is formed to include a plurality of high velocity spray jets for directing cleaning fluid onto the bottom (i.e., abrasive surface), sides and top of a conditioner head, as well as the end effector to which the conditioner head is attached. The plurality of jets includes a spray outlet in the base of the cleaning cup for directing a spray of cleaning fluid upward onto the exposed surface of the abrasive. The velocity of the upward-directed spray having a sufficient energy and/or angle to break the bonds holding the residue in place. Additional spray jets are formed as vertical spray stems and used to direct sprays of cleaning fluid onto the top and sides of the conditioner head. The cleaning cup itself is formed to include a pair of deflectors, disposed between the spray stems, that are used to re-direct the cleaning fluid from the perimeter of the cup back onto the sides of the conditioner head.

In one embodiment, the spray outlet within the base of the cleaning cup is formed as a knife spray for directing a sheet of high velocity spray upward onto the abrasive surface. In systems where the conditioner head is rotated during cleaning, a single knife formed across a radius of the base may be used to efficiently clean the entire abrasive surface. In systems where the conditioner head remains stationary, a plurality of spray knives may be used. Alternatively, a shower head type of spray fixture may be used to direct high velocity streams upward onto the abrasive surface. In any of these arrangements, the velocity of the cleaning fluid spray must be sufficient to overcome the surface tension associated with the "static bath" of cleaning fluid held within the cleaning Cup.

In a further embodiment of the present invention, the spray outlet exhibits a particular geometry that will induce turbulence in the "static bath" held within the cleaning cup. The turbulence creates additional flow toward the spray outlet, adding volume to the spray and reducing the force required to escape the surface tension of the bath. Alternatively, the bath can be foamed by injecting gas, as in the prior art, reducing the resistance seen by the high velocity streams of cleaning fluid.

The vertical spray stems are formed to include a plurality of separate spray apertures and may be assembled in an adjustable configuration so that the separate jet streams may be directed to particular portions of a conditioner head that are more susceptible to carrying particulates. In vacuum-assisted conditioning systems, the cleaning fluids can be drawn through and/or around the abrasive, thus eliminating any interference with the static bath. Sequencing the vacuum can create additional flux and thus serve to pull a 'slug' of cleaning agent across, around and through the abrasive tooling.

It is an advantage of the present invention that the use of a plurality of high velocity jets of cleaning fluid results in creating targeted streams of cleaning fluid that impart cleaning energy on the conditioner surfaces, and result in atomized fluid 'clouds/mist' which condense on the conditioner head to keep broad surfaces moist between conditioning operations. Both the high velocity streams (for compacted residue and flat surfaces) and the atomized droplets (for non-working surface areas of the conditioner) are able to break the bond between the particulate matter and the conditioner head surfaces and force the particulate into the bath fluid (and ultimately drained or vacuumed away from the apparatus).

In yet another embodiment of the present invention, a gas may be dissolved in the cleaning fluid prior to entering the cleaning cup, where upon passing through the spray jets the gas is released and serves to further atomize the cleaning fluid and increase the efficiency of the cleaning operation. The gas itself may include an one or more components that are used to control the chemistry of the cleaning fluid.

Additionally, venturi systems can be incorporated into the spray outlet jet fixtures such that the bath is drawn down locally around the jets in the spray outlet by 'drains' connecting to the venturi-created pressure drop, further reducing the interference created by the static bath.

Other and further embodiments and features of the present invention will become apparent during the course of the following discussion and by reference to the accompanying drawings.

BRIEF DESCRIPTION OF THE DRAWINGS

Referring now to the drawings.

DETAILED DESCRIPTION

Figure 1:
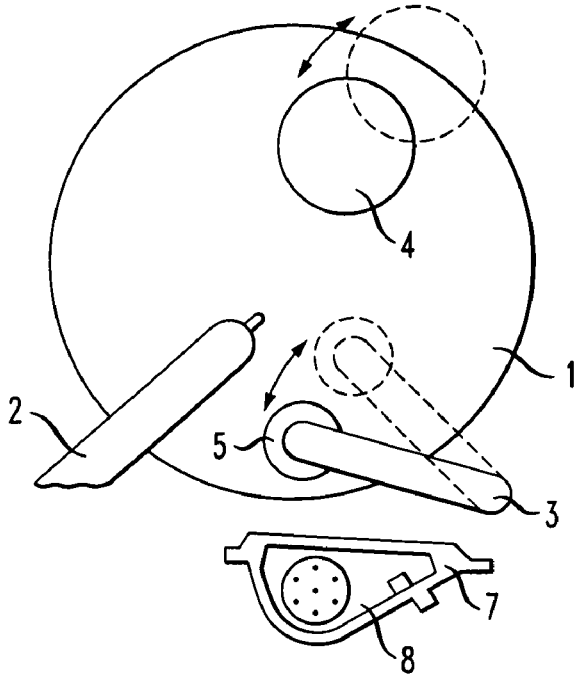
FIG. 1 PRIOR ART
FIG. 1 is a simplified top view of a prior art CMP system.
Figure 2:
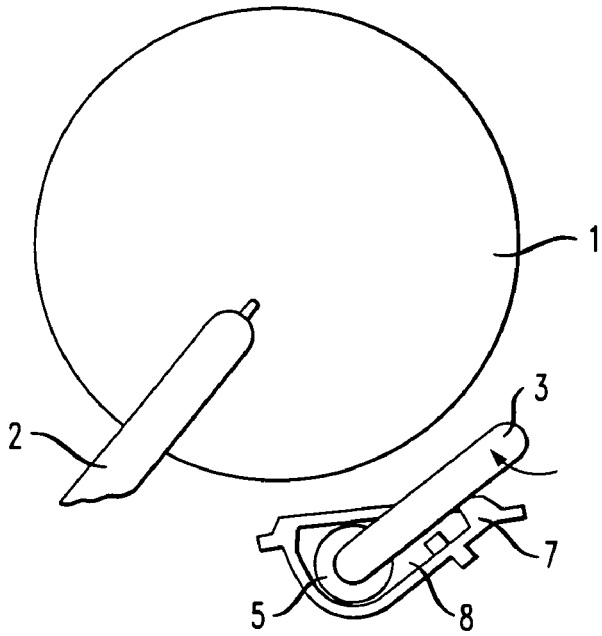
FIG. 2 PRIOR ART
FIG. 2 illustrates the same prior art system as shown in FIG. 1, in this view with the conditioning arm rotated to be located over the associated cleaning cup.

FIGS. 1 and 2 are simplified top views of a typical prior art CMP apparatus, including a polishing pad 1, polishing slurry dispensing arm 2, and a conditioning arm 3. FIG. 1 illustrates the apparatus in its typical operating state, where a semiconductor wafer 4 is positioned on polishing pad 1. Conditioning arm 3, including a conditioner head 5 with an abrasive conditioning surface (not shown), is mounted on a rotating base so that arm 3 sweeps back and forth (as shown by the double-ended arrow) to constantly clean a portion of polishing pad 1 (where pad 1 itself rotates during CMP processing). A cleaning cup 7 is located off to one side of the apparatus, and includes a recessed portion 8 for holding a cleaning solution ("bath"). In this particular arrangement, recessed portion 8 includes a plurality of apertures that allows for gas bubbles to be injected into the bath and assist in removing built-up slurry residue from the abrasive surface of conditioner head 5. In the illustration of FIG. 2, the conditioning process has halted and conditioning arm 3 has been moved over to cleaning cup 7.

In standard practice, conditioner head 5 is lowered into recessed portion 8 of cup 7 and immersed in the cleaning solution. The immersion is used to keep the abrasive conditioning disk moist between conditioning processes. Historically, it was presumed that as long as the conditioner head was not permitted to dry out, little if any slurry would remain on the conditioner head after submersion in the cleaning bath. It has since been discovered that the slurry may still adhere to the various surfaces of the conditioner head after cleaning, including the abrasive disk, resulting in a situation now referred to as "disk fouling"—where adhered slurry has been found to change the mechanical behavior of the conditioning disk during subsequent conditioning processes.

Figure 3:
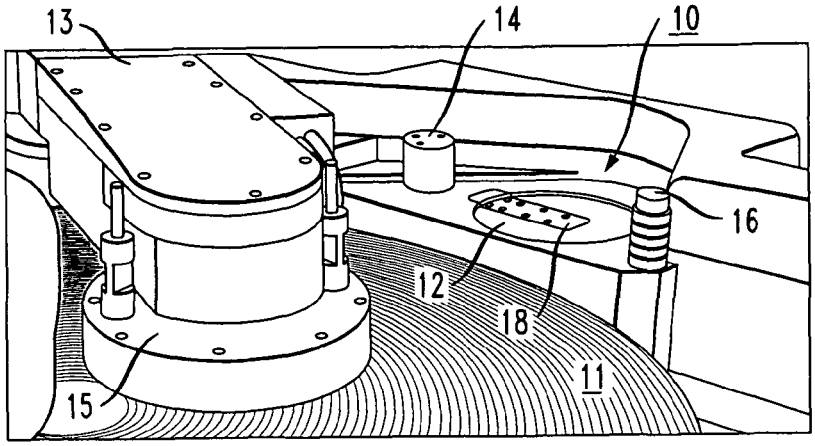
FIG. 3 is a first isometric view of an exemplary cleaning cup system formed in accordance with the present invention.
Figure 4:
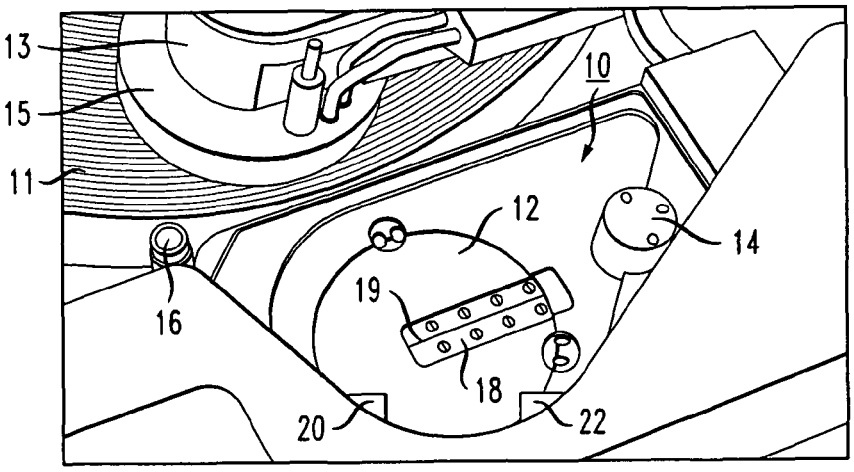
FIG. 4 is a second, alternative isometric view of the same embodiment as shown in FIG. 3.

FIGS. 3 and 4 illustrate, in different isometric views, a portion of an exemplary CMP system including a cleaning cup 10 formed in accordance with the present invention to overcome the problems of the prior art. Also shown in these views is a portion of a conditioning arm 13 and a conditioner head 15. The underside of conditioner head 15 (not shown) includes an abrasive disk, brush or other arrangement used in the art to perform the conditioning operation on a polishing pad. A portion of a polishing pad 11 is also shown in FIGS. 3 and 4.

Figure 5:
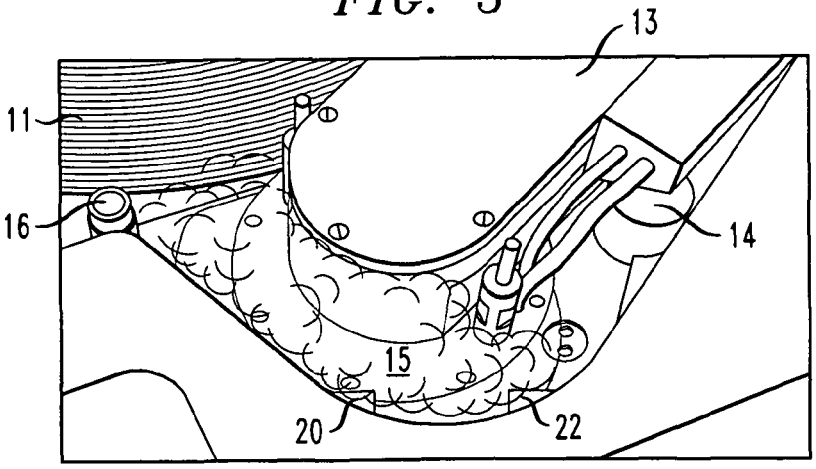
FIG. 5 is an isometric view of the same arrangement as shown in FIGS. 3 and 4, in this case with the conditioning arm located over the cleaning cup.

Similar to the various prior art arrangements, cleaning cup 10 includes a recessed area 12 that is filled with an appropriate cleaning solution (for example, deionized water) into which conditioner head 15 is lowered when not in use. FIG. 5, discussed in detail below, illustrates this immersed positioning of conditioner head 15.

In contrast to prior art "static bath" arrangements, however, cleaning cup 10 of the present invention utilizes multiple, high velocity sprays of cleaning solutions to forcibly remove the unwanted slurry and other material from various surfaces of conditioner head 15. As shown in FIGS. 3 and 4, cleaning cup 10 includes a high velocity spray outlet 18 formed within the floor of recessed area 12. In this particular embodiment, spray outlet 18 is configured as a water knife positioned within recessed area 12 so that the spray will be directed upward against a radial portion of the abrasive surface of conditioner head 15. It is presumed that conditioner head 15 is rotated at least once while in the retracted position over cleaning cup 10 so that water knife 18 will have the opportunity to spray the entire abrasive surface area of conditioner head 15. Alternatively, if the conditioner head is not rotated while in position over the cleaning cup, a plurality of water knives (or apertures forming a showerhead-type of arrangement) may be used to ensure that the entire surface area of the abrasive is subjected to the high velocity spray of cleaning fluid (see, for example, FIGS. 8 and 9). In operation, water knife 18 releases a stream of cleaning fluid through aperture (s) 19 with a velocity that is sufficient to break through the static layer of cleaning fluid and impinge the rotating abrasive surface of conditioner head 15. In one embodiment, an aperture 19 may comprise a precision slot that is 0.0002 inches wide and 2.25 inches long.

Cleaning cup 10 is seen as also including a pair of vertical spray stems 14 and 16 in the form of restrictors, positioned as shown at the outer perimeter of cup 10. Spray stems 14 and 16 each comprise a plurality of individual jets that are used to direct targeted streams of high velocity water (or any other suitable cleaning fluid) against the side and top surfaces of conditioner head 15. A pair of deflectors 20, 22 (best seen in FIG. 4) is formed along the sidewall of cleaning cup 10 between spray stems 14 and 16, where the deflectors are used to re-direct the streams of fluid back against the side surface of conditioner head 15. While this particular embodiment illustrates the use of a pair of vertical spray stems, it is to be understood that various other arrangements may utilize a different number of such stems, primarily as a function of the configuration of the cleaning cup and the perimeter area available for incorporating a spray stem.

It has been found that used slurry and other debris may cover various exposed areas of the end effector portion of conditioning arm 13 during the conditioning process. It is an advantage of the arrangement of the present invention that the high velocity sprays directed from stems 14 and 16 will loosen and remove any material from the outer surface of the conditioner head 15, as well as from the underlying abrasive conditioning disk and/or other conditioning system elements such as, for example, a vacuum cup. Upon impinging the surfaces of conditioner head 15, the high velocity streams will atomize and the energy from the collision will break the adhesion between the slurry residue and conditioner head outer surface. It has been found that there is a pressure-induced cohesive force and/or a charge affinity between adjacent slurry particles (agglomeration) that adheres the residue to the conditioner's surfaces. The energy from the high velocity streams has been found to be sufficient to break these bonds and liberate the residue from these surfaces.

FIG. 5 is an isometric view of conditioner arm 13 positioned over cleaning cup 10 such that conditioner head 15 is immersed in the cleaning bath solution. Shown in this view are the high velocity streams from spray stems 14 and 16 as directed toward conditioner head 15. In conditioner arrangements that include a vacuum system for removing debris from the polishing pad, this same vacuum system may be activated during the cleaning process, allowing for the removed material and used cleaning fluid to be removed from the cleaning cup and continuously replaced with fresh fluids. Moreover, the vacuum outer housing surrounding the conditioner head permits the abrasive surface to be cleaned without concern regarding the surface contacting the cleaning cup itself (since the vacuum housing will first contact the cleaning cup). Thus, the conditioner head may continue to rotate in either the 'retracted' or 'extended' (down) position, where this is not possible in current designs. Indeed, the use of the vacuum removal system eliminates the need for a separate drain and allows for the spraying and vacuuming to continue simultaneously while the conditioner is immersed in the cleaning cup.

Figure 6:
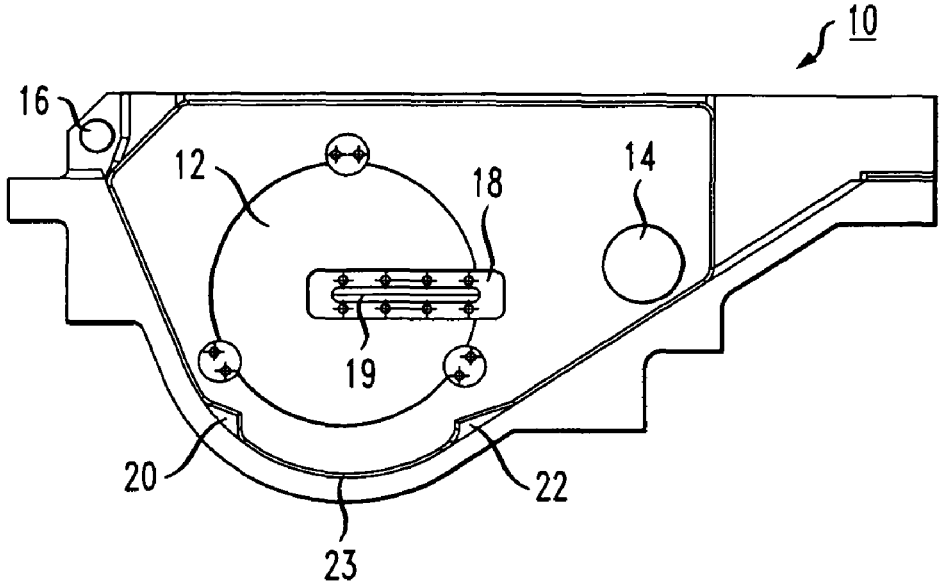
FIG. 6 is a simplified top view of an exemplary cleaning cup arrangement formed in accordance with the present invention, illustrating the positioning of the deflectors along the side wall of the cleaning cup.
Figure 7:
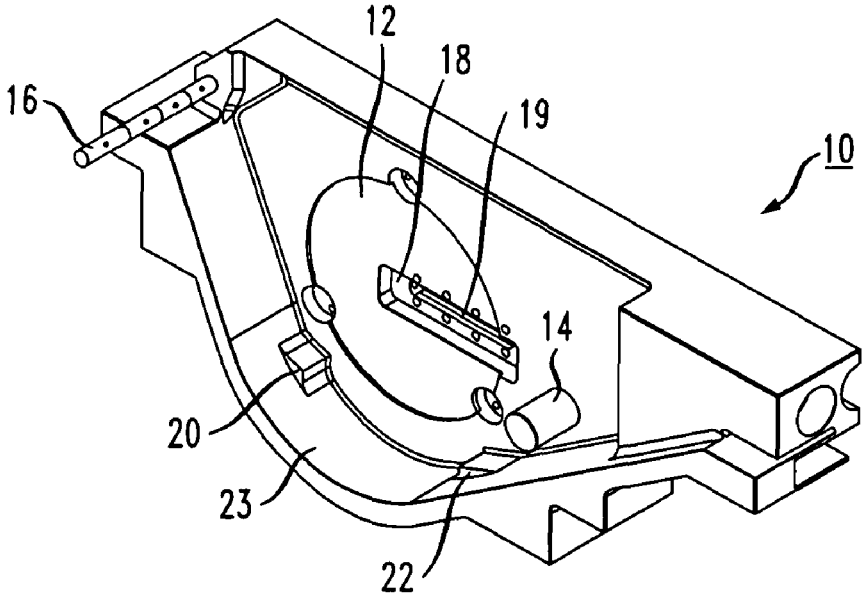
FIG. 7 is an isometric view of the arrangement of FIG. 6, further illustrating the recessed placement of the water knife within the bottom surface of the cleaning cup.

FIG. 6 is a simplified top view of cleaning cup 10, in this view clearly illustrating the location of deflectors 20 and 22 with respect to vertical spray stems 14 and 16. In a preferred embodiment, deflectors 20 and 22 are formed as protrusions directly molded into sidewall 23 of cleaning cup 10. While this embodiment illustrates the use of a pair of deflectors, it is to be understood that other arrangements of the present invention may utilize fewer or more deflectors, where the deflectors themselves may exhibit different shapes or be disposed in different locations or at different angles, all for the purpose of re-directing cleaning fluid/energy back against the conditioner head surfaces. The isometric view of FIG. 7 clearly depicts the location of water knife 18 within recessed area 12. It is important to note that water knife 18 (or any other type of spray outlet 18) needs to be recessed below the base of area 12 (or stand-offs) to prevent direct contact between the spray outlet and the abrasive surface of conditioner head 15.

In one embodiment, water knife 18 is formed of a suitable metal and is sufficiently recessed so that an overlying abrasive surface of conditioner head 15 (not shown in this view) will remain clear of knife 18. As discussed below in association with FIG. 13, water knife 18 may be formed of a geometry that induces turbulent flow in its proximity, causing flow within the static liquid forming the bath and directing a portion of that flow toward aperture 19 to join with the incoming stream of cleaning fluid. The creation of the turbulence has been found to reduce the surface tension of the static bath and more easily allow for the upward high velocity stream of cleaning fluid to escape the surface of the bath.

Figure 8:
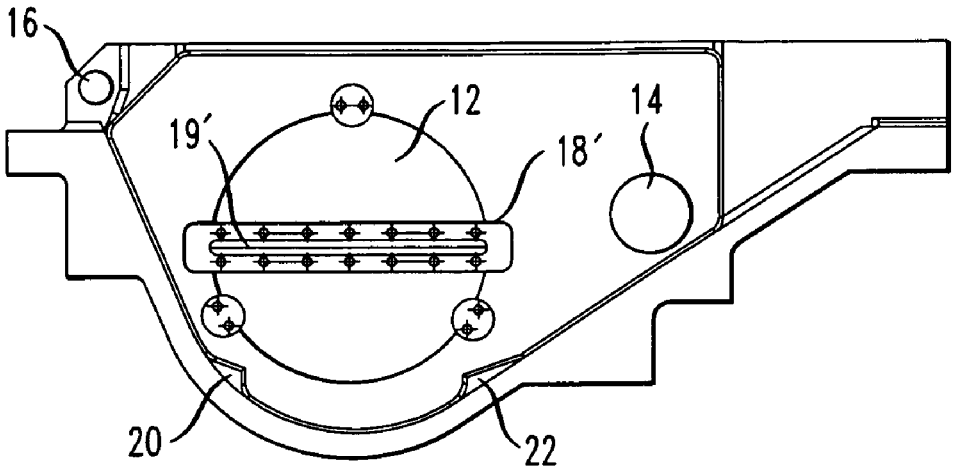
FIG. 8 is a simplified top view of an alternative embodiment of the present invention, using an extended water knife for directing a high velocity spray against the conditioner head abrasive surface.
Figure 9:
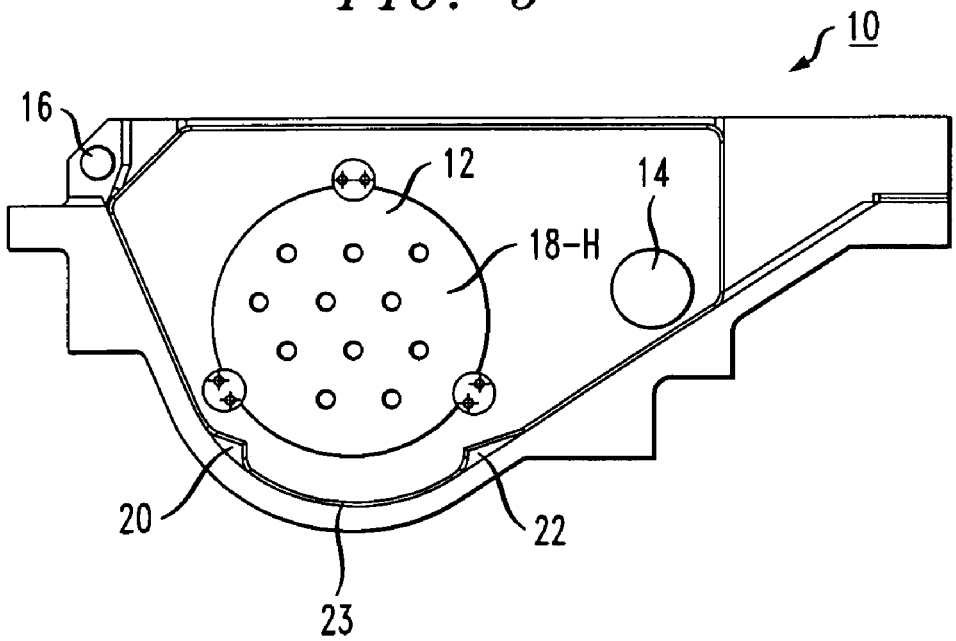
FIG. 9 is a simplified top view of yet another embodiment of the present invention, in this case using a plurality of separate high velocity jets within the base of the cleaning cup in place of a water knife.

As mentioned above, there may be arrangements where the conditioner head remains stationary while immersed in the cleaning fluid. In this case, a plurality of spray outlet sources may be included within recessed area 12 to provide sufficient coverage of the abrasive surface. FIG. 8 is a top view of an alternative embodiment using an extended water knife 18', disposed to cover the entire diameter of an overlying abrasive disk. FIG. 9 illustrates an alternative embodiment where spray outlet 18 comprises a plurality of holes 18-H formed in recessed area 12. In this embodiment, a plurality of separate, high velocity streams of cleaning fluid is directed upward through each of these holes so as to impact the abrasive surface of conditioner head 15.

Figure 10:
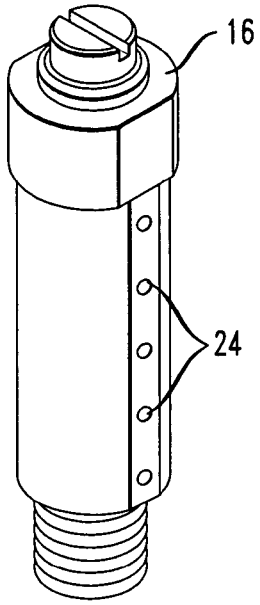
FIG. 10 is an isometric view of an exemplary vertical spray stem for use in the cleaning cup arrangement of the present invention, including a plurality of separate spray jets for cleaning the sides and top of a conditioner head.

Spray stems 14 and 16, as described above, are formed as vertical, columnar restrictors that for directing high velocity streams of cleaning fluid toward the top and sides of the end effector portion of conditioning arm 13. FIG. 10 is an isometric view of an exemplary spray stem 16, including a plurality of jets 24, where each jet is used to direct a separate stream toward conditioner head 15. In situations where an incoming gas is mixed with the cleaning fluid, jets 24 are restrictor valves, controlling the pressure of the output stream in a known manner to provide the most efficient atomization of the stream. In one embodiment, jets 24 mat comprise holes that are 0.007 inches to 0.011 inches in diameter. The size and number of apertures used may be configured to provide the particular spray pattern, water usage and velocity that is desired.

Figure 11:
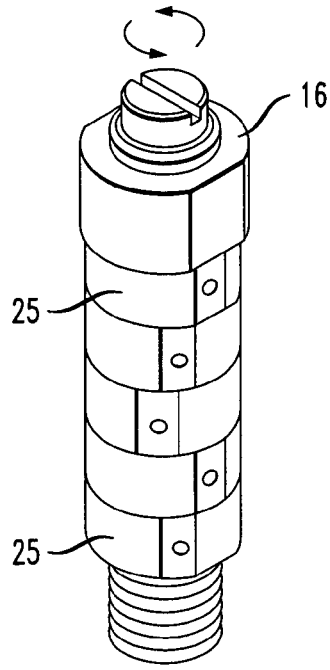
FIG. 11 is an isometric view of an alternative, adjustable vertical spray stem, where in this embodiment the plurality of spray jets are separately adjustable for positioning the individual jets so as to best clean the surfaces of a conditioner head.

Preferably, jets 24 are formed so as to be adjustable, allowing for the user to control the direction of each individual stream so as to best clean the surface of a given conditioner head design. FIG. 11 illustrates spray stem 16, as described above in association with FIG. 10, where in this example, each jet 24 is formed within a separate ring member 25. Ring members 25 can be rotated about the central axis of stem 16, allowing for the positions of the individual jets to be adjusted as shown in the illustration to provide the best coverage. Other adjustable arrangements are possible and are considered to fall within the scope of the present invention.

Figure 12:
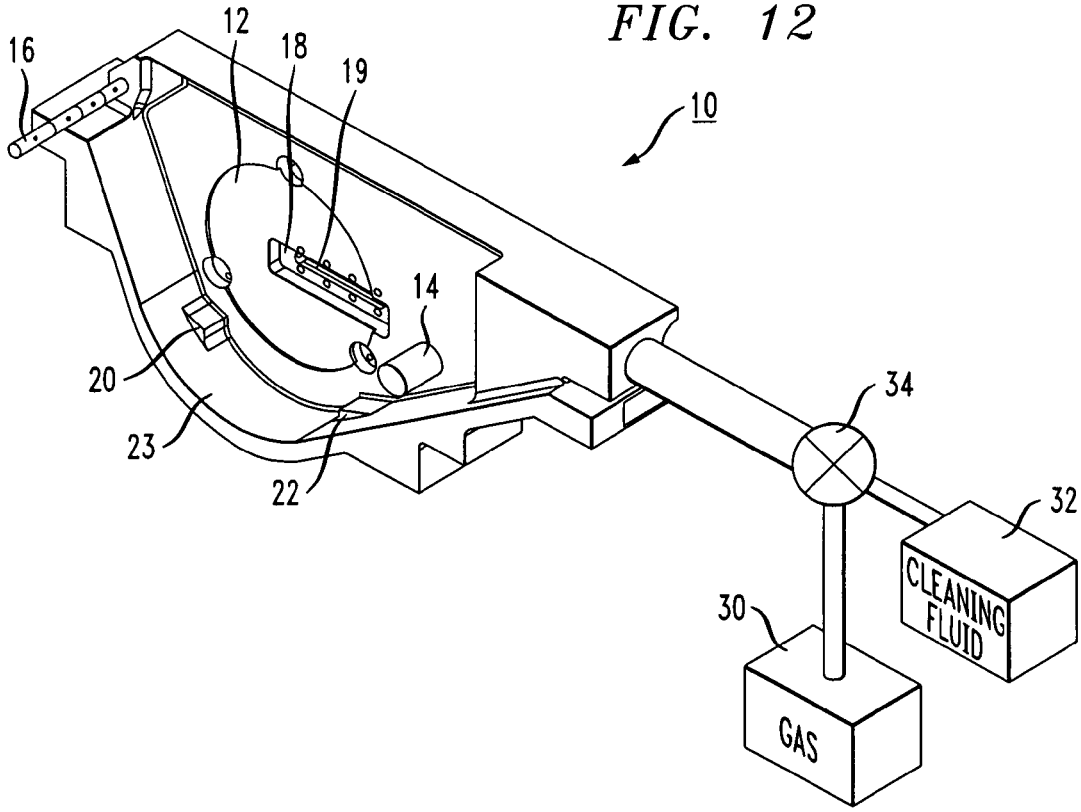
FIG. 12 is an isometric view of another embodiment of the present invention, in this case introducing a gas source with the cleaning fluid, the gas pressurized to further atomize the cleaning fluid upon impact with the surfaces of the conditioner head.

FIG. 12 illustrates an alternative embodiment of the present invention, where a gas source 30 is mixed with a source 32 of cleaning fluid (such as, for example, deionized water) through a mixing valve 34 before being introduced into cleaning cup 10. In this embodiment, the gas dissolves in the cleaning fluid and will thereafter be released as the fluid escapes through spray outlet 18 and spray stems 14, 16. It has been found that the addition of the gas will create more atomization of the cleaning fluid upon contact with the conditioner head surfaces, resulting in dispersing more of the cleaning material over the complete surface of the conditioner head and improving the efficiency and quality of the cleaning process. The gas may be an inert gas, or include oxygen (e.g., $CO_2$ or ozone) that may be useful in controlling the pH of deionized water when used as the cleaning fluid. Other gas chemistries may be useful in different situations and are considered to fall within the spirit and scope of the present invention.

Figure 13:
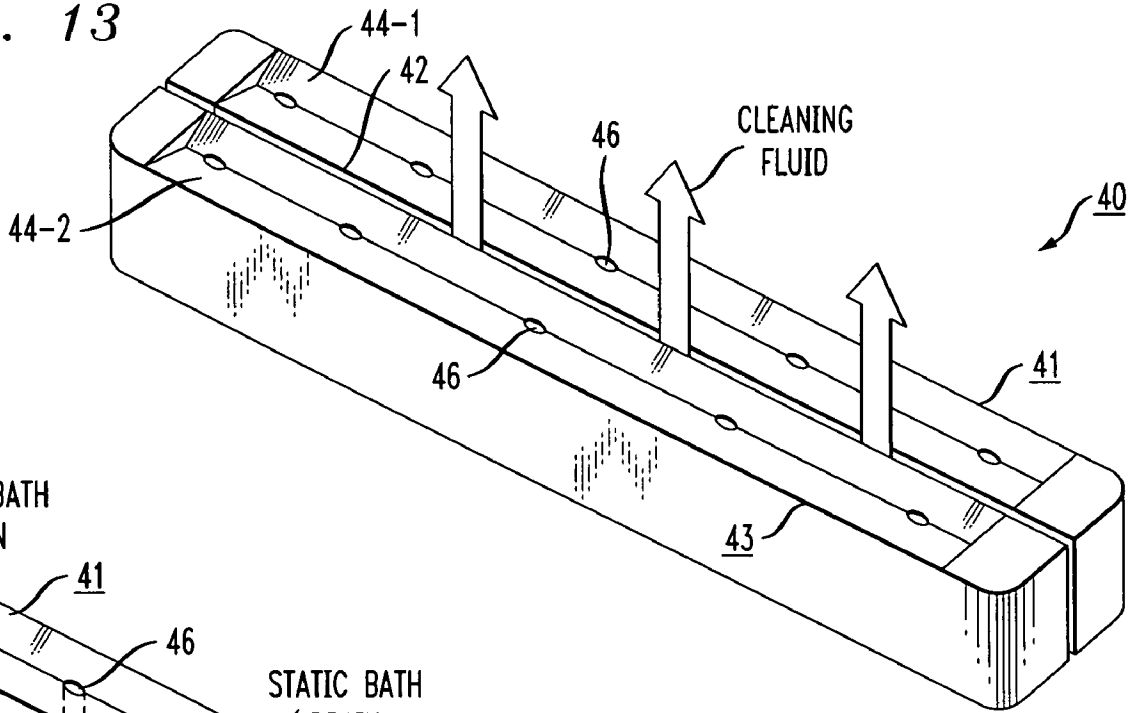
FIG. 13 illustrates an exemplary water knife configuration for creating venturi action within the static bath of the cleaning cup, directing additional fluid towards the water knife and decreasing the surface tension of the bath.

As mentioned above, the geometry of spray outlet 18, in particular a water knife may be designed to create fluid motion within the static bath, creating turbulence that reduces the surface tension and reduces the force required by the upward-directed stream to break through the bath. FIG. 13 illustrates one exemplary water knife 40 that may be used for this purpose. Water knife 40 comprises a pair of adjacent components 41 and 43, where the separation between components 41 and 43 forms a central outlet 42, similar to aperture 19 of water knife 18 as described above. Additionally, water knife 40 includes a pair of longitudinal V-groove channels 44-1 and 44-2, which function to direct the fluid of the static bath in the direction of aperture 42. Each channel 44 further comprises a plurality of apertures 46 that gravity feeds a portion of the cleaning fluid toward aperture 42 and/or channel material to the venturi inlets.

Figure 14:
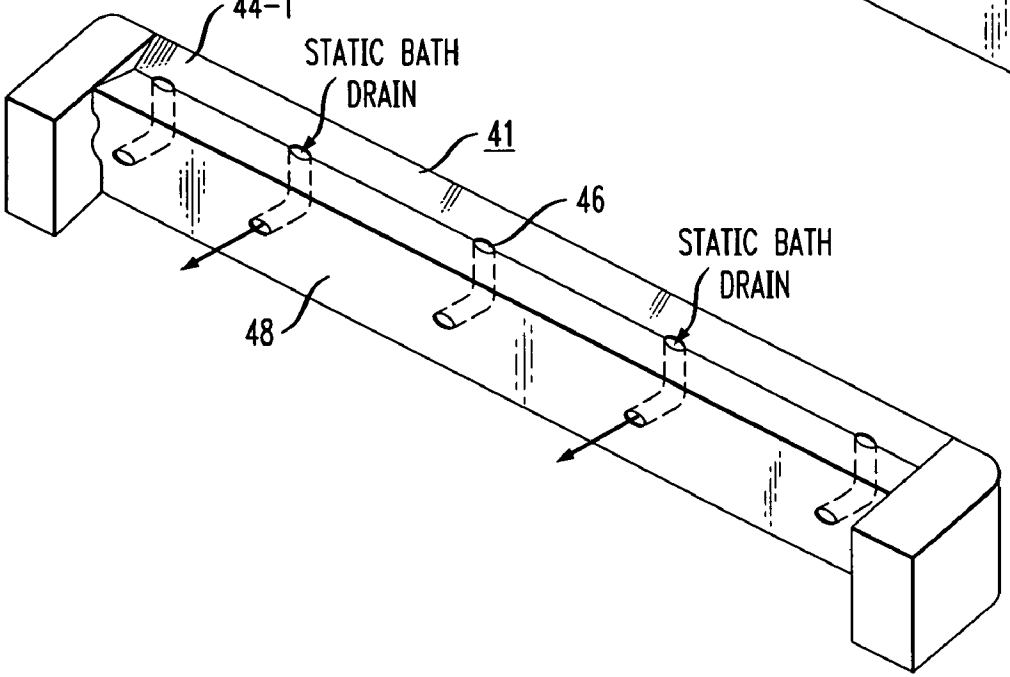
FIG. 14 is a cut-away side view of the venturi water knife configuration of FIG. 13.

FIG. 14 is a cut-away side view of water knife 40, taken along the location of aperture 42. Evident in this view is the draining movement of cleaning fluid through apertures 46 and into the area of central aperture 42, as defined by sidewall 48. Indeed, central aperture is created by maintaining a predetermined, narrow spacing between adjacent sidewalls of components 41 and 43 of water knife 40. As mentioned above, the venturi action of the fluid serves to increase the volume of liquid incorporated into the stream of cleaning fluid from the base of the cleaning cup.

It is to be understood that the cleaning cup of the present invention may utilize various cleaning fluids, or combinations of fluids and/or gasses, in order to provide the most efficient cleaning operation. Indeed, the particular cleaning materials selected may be a function of the chemical composition of the polishing slurry, the material being removed from the wafer, the composition of the abrasive conditioning disk, etc.

What is claimed is:

1. An apparatus for cleaning a polishing pad conditioner comprising a cleaning cup including a recessed area into which a polishing pad conditioner is lowered during cleaning, the cleaning cup formed to support a bath of cleaning fluid and the recessed area formed to include a high velocity spray outlet for directing a stream of cleaning fluid against the polishing pad conditioner, the high velocity spray outlet comprising at least one venturi water knife including a central spray slot in the form of a V-shaped channel region for inducing movement in the bath of cleaning fluid for directing a sheet of cleaning fluid against the polishing pad conditioner and a plurality of drains for directing the cleaning fluid into said central spray slot; and at least one vertical spray stem disposed adjacent to the cleaning cup, the at least one vertical spray stem including a plurality of separate spray jets for directing a plurality of separate streams of cleaning fluid against exposed surfaces of the polishing pad conditioner.

2. The apparatus as defined in claim 1 wherein the high velocity spray outlet comprises a plurality of high velocity spray jets for directing a plurality of streams of cleaning fluid against the polishing pad conditioner.

3. The apparatus as defined in claim 1 wherein the plurality of separate spray jets are separately adjustable to position the direction of the cleaning fluid streams.

4. The apparatus as defined in claim 1 wherein the apparatus further comprises at least one deflector disposed along a sidewall of the cleaning cup, the at least one deflector for redirecting streams of cleaning fluid toward the polishing pad conditioner.

5. The apparatus as defined in claim 4 wherein the at least one vertical spray stem comprises a pair of vertical spray stems and the at least one deflector is disposed between the pair of vertical spray stems.

6. The apparatus as defined in claim 4 wherein the at least one deflector comprises a protrusion directly molded into the sidewall of the cleaning cup.

7. The apparatus as defined in claim 1 wherein the apparatus further comprises a cleaning fluid source, coupled to the high velocity spray outlet and the at least one vertical spray stem.

8. The apparatus as defined in claim 7 wherein the apparatus further comprises a mixing valve; and a gas source, the gas source and the cleaning fluid source applied as inputs to the mixing valve, the output stream being the cleaning fluid with the gas dissolved therein and the output stream thereafter applied as the input to the high velocity spray outlet and the at least one vertical spray stem.

* * * * *